United States Patent [19]

Rizzo et al.

[11] 4,345,868

[45] Aug. 24, 1982

[54] WASTE RECEPTACLE DUMPING MECHANISM

[76] Inventors: Charles P. Rizzo, 33552 Chatsworth, Sterling Heights, Mich. 48077; Stephen Barraco, 55327 Broughton, Mt. Clemens, Mich. 48044; James Quinn, 40900 Production Dr., Mt. Clemens, Mich. 48045

[21] Appl. No.: 169,515

[22] Filed: Jul. 21, 1980

[51] Int. Cl.[3] ..... B65F 3/00

[52] U.S. Cl. ..... 414/408; 414/694

[58] Field of Search ..... 414/408, 694, 706, 707, 414/710, 714

[56] References Cited

U.S. PATENT DOCUMENTS

| | | | |
|---|---|---|---|
| 3,140,787 | 7/1964 | Clar | 414/408 |
| 3,167,195 | 1/1965 | Jensen et al. | 414/408 |
| 3,921,839 | 11/1975 | Herpich | 414/408 |
| 4,091,944 | 5/1978 | Gollnick | 414/408 |

*Primary Examiner*—George E. A. Halvosa
*Assistant Examiner*—L. E. Williams
*Attorney, Agent, or Firm*—Basile, Weintraub & Hanlon

[57] ABSTRACT

A waste receptacle dumping mechanism. The receptacle dumping mechanism of the present invention comprises a vehicle mounted cylinder actuated mechanism for engaging and translating waste receptacles from a first position in front of the vehicle to a second position over a waste receiving opening associated with a vehicle container. A cylinder is provided for tilting and emptying the receptacle once it has been placed above the opening. The mechanism of the present invention provides improved adjustable stabilizer rods which provide for accurate engaging of the dumping mechanism with the waste receptacle as well as extending the life of the mechanism and reducing the amount of down time for repairs.

1 Claim, 2 Drawing Figures

Fig-1
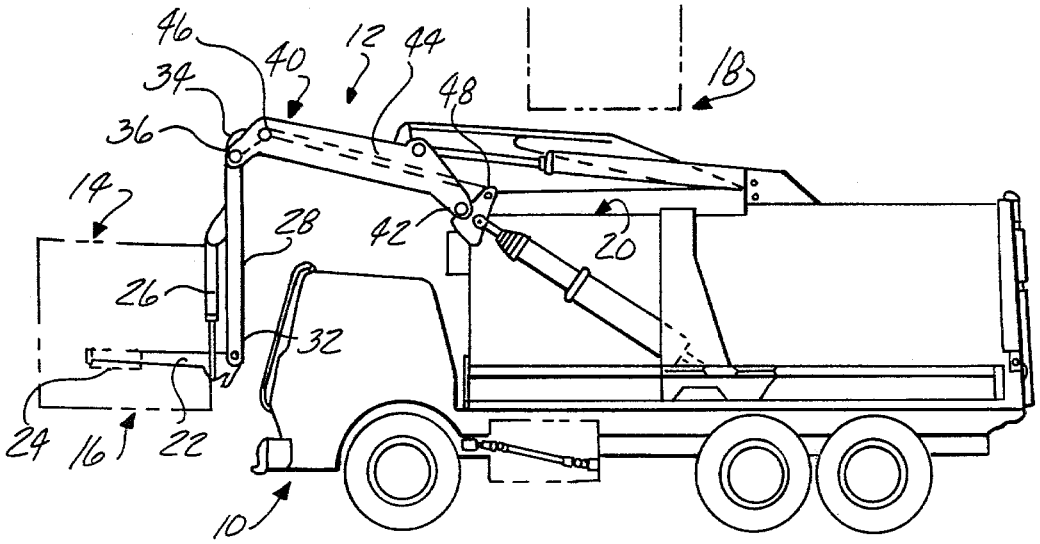
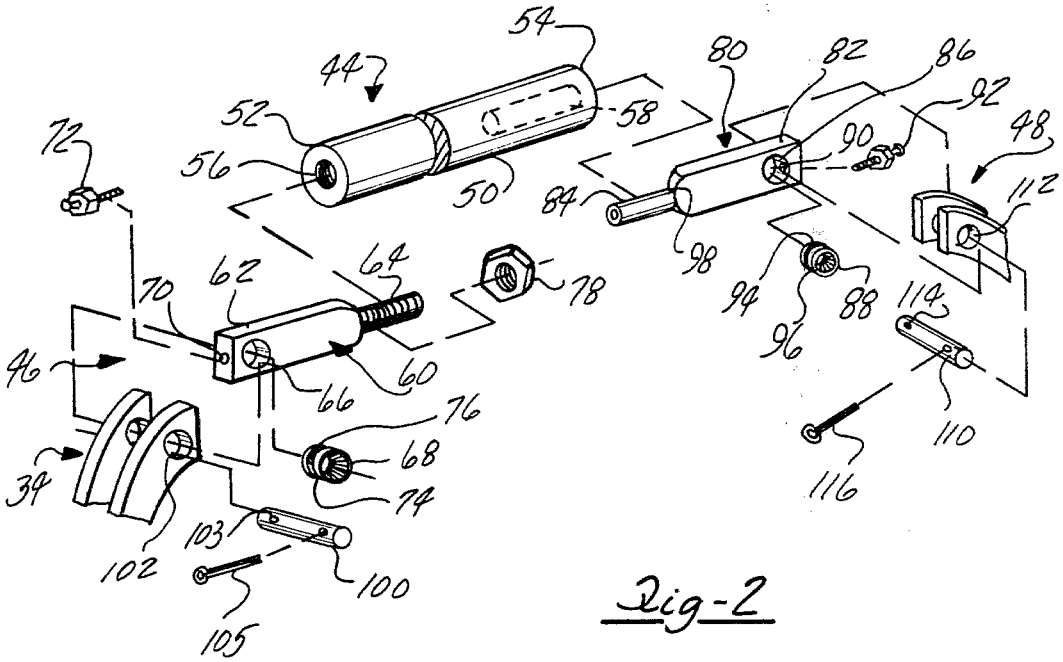
Fig-2

WASTE RECEPTACLE DUMPING MECHANISM

BACKGROUND OF THE INVENTION

I. Field of the Invention

The present invention relates generally to the field of vehicle mounted lifting devices and, in particular, the present invention is concerned with vehicle mounted lifting devices including a mechanism for engaging a waste receptacle at a front portion of the vehicle and translating the receptacle to a position over an opening in the vehicle and dumping the receptacle contents into the opening.

II. Description of the Prior Art

Vehicle mounted lifting devices for lifting and translating articles and receptacles are known. Vehicle mounted lifting mechanisms are disclosed in U.S. Pat. Nos.: 2,653,678; 2,701,068; 3,586,183; 3,739,929; 3,805,979; and 4,056,203. These United States patents are relevant in that they disclose a vehicle mounted lift mechanism employing hydraulic cylinders to engage and lift the load. U.S. Pat. Nos. 2,823,813, 3,732,995; and 3,804,277 disclose vehicle mounted lifting and dumping mechanisms wherein a fork or engaging device is disposed at a front end of the vehicle. The fork is employed to engage the load, transport the load and deposit the load either in the vehicle or in a convenient location. These patents are relevant to the Applicant's invention in that they represent the closest prior art for utilizing a vehicle mounted mechanism for engaging and translating a waste receptacle from a position in front of the vehicle to a second position.

SUMMARY OF THE INVENTION

The present invention, which will be described in greater detail hereinafter, comprises an improved receptacle dumping mechanism which includes a vehicle mounted cylinder actuated mechanism for engaging and translating a waste receptacle from a first position in front of the vehicle to a second position over a waste receiving opening at a rear portion of the vehicle. The mechanism includes a fork for releasably engaging the receptacle and a cylinder means for pivoting the fork and dumping the contents of the receptacle into the waste receiving opening. The fork is supported by a pair of spaced vertical arms each having a lower end pivotably supporting the fork and an upper end. A pivot spaced downwardly from each of the upper ends pivotally engages a forward end of a pair of spaced swinging arms. The swinging arms are pivotably supported by the vehicle at a rear end thereof. A pair of adjustable stabilizer rods are provided to maintain the receptacle parallel to the ground as the swinging arms are raised to move the receptacle from a first position in front of the vehicle to a second position above and to the rear of the vehicle over the waste receiving opening. The adjustable stabilizer rods include a front end pivot attached to the upper end of the vertical arms and a back end pivot pivotably attached to the vehicle. The adjustable stabilizer rods are selectively variable in length to determine the spacing between the front end of the vehicle and the receptacle when the mechanism is in the first position. The front end and back end pivots must have a minimum of friction and a minimum amount of radial play to assure the correct positioning of the fork when engaging the receptacle. A high friction for the front end pivot and the back end pivot would induce wear and result in back lash and poor targeting of the fork with the receptacle. A slight amount of radial play in the pivots induces considerable back lash in the linkage and a resulting jerky motion which can spill refuse from the receptacle. Even a minor amount of play in the pivots will induce early and rapid wear and a need for frequent and costly replacement of the bushings.

The adjustable stabilizer rod of the present invention includes front and back end bearing supports with the front and back end pivots comprising a roller bearing snugly pressed into a bearing bore formed in the bearing support and a hardened pin rotatingly engaging the roller bearing. The pin for the rear end pivot snugly engages a pair of aligned apertures formed in a pair of spaced apart walls projecting from the vehicle body. The pin associated with the front end pivot snugly engages a pair of aligned apertures formed in the upper end extending across a slot formed therein with the front end bearing support transversely positioned by the slot.

It is therefore a primary object of the present invention to provide a new and improved vehicle mounted waste receptacle dumping mechanism.

It is a further object of the present invention to provide such a vehicle mounted receptacle dumping mechanism that is durable and provides a minimum of play in the linkage.

It is yet another object of the present invention to provide an improved vehicle mounted waste receptacle dumping mechanism that accurately targets receptacle engaging forks with the receptacle.

It is a further object of the present invention to provide an improved vehicle mounted receptacle dumping mechanism that is smooth in operation and has a minimum of down time due to equipment failures.

Further objects, advantages, and applications of the present invention will become apparent to those skilled in the art of the vehicle mounted waste receptacle dumping mechanisms when one example of the best mode contemplated for practicing the invention is read in conjunction with the accompanying drawing.

BRIEF DESCRIPTION OF THE DRAWING

In the drawing, like reference numbers refer to like parts throughout the several views, and wherein:

FIG. 1 illustrates a side view of a vehicle utilizing the improved waste receptacle dumping mechanism of the present invention; and FIG. 2 illustrates a broken exploded perspective view of the adjustable stabilizer rods of the present invention.

DESCRIPTION OF THE PREFERRED EMBODIMENT

Referring now to the drawing, there is illustrated one example of the present invention in FIG. 1 in the form of a vehicle 10 utilizing an improved waste receptacle dumping mechanism 12 of the present invention. The mechanism 12 is adapted to provide a cylinder actuated mechanism for engaging and translating a waste receptacle 14 from a first position 16 in front of the vehicle to a second position 18 over a waste receiving opening 20 at a rear portion of the vehicle. A fork 22 associated with the mechanism 12 releasably engages a pair of cleats 24 positioned on either side of the receptacle 14, and a cylinder means 26 is provided for pivoting the fork and dumping the contents of the receptacle 14 into the waste receiving opening 20. The fork 22 is supported by a pair of spaced vertical arms 28 having lower ends 32 and upper ends 34 with the lower ends 32 pivotally engaging the fork 22. A pivot support 36 is provided in each arm 28 spaced downward from the upper end 34 to pivotally engage a forward end of a pair of spaced swinging arms 40. Each swinging arm 40 includes a rear end 42 pivotally supported by the vehicle.

The mechanism 12 further includes a pair of adjustable stabilizer rods 44 including a front end pivot 46 pivotally attached to the upper end 34, and a back end pivot 48 pivotally attached to the vehicle 10.

As can best be illustrated in FIG. 2 of the drawing, the stabilizer rods 44 and their pivots 46,48 are configured to stabilize the waste receptacle 14 in a horizontal position as the swinging arms 40 translate the receptacle from the first position 16 to the second position 18. As illustrated in FIG. 2 of the drawing, the stabilizer rods 44 comprise a central rod 50 including a front end 52 and a back end 54, with a threaded bore 56 formed longitudinally in the rod front end 52 and a central bore 58 formed longitudinally in the rod back end 54. A front end bearing support 60 includes an enlarged end 62 and a threaded end 64 threadingly engaging the threaded bore 56. The enlarged end 62 includes a first bearing bore 66 formed therein to snugly receive a first roller bearing 68. A threaded aperture 70 is formed in the enlarged end 62 in communication with the bearing bore 66, and a grease fitting 72 threadingly engaging the threaded aperture 70 allows the introduction of grease into the bearing bore 66. The first roller bearing 68 includes a groove 74 formed along the perimeter thereof aligned with the threaded aperture 70 and an aperture 76 formed at a bottom of the groove 74 communicating between the groove and the rollers of the first bearing 68 to grease the rollers. A lock nut 78 threadingly engages the threaded end 64 of the front end bearing support 60 with the threaded end 64 threadingly engaging the threaded bore 56, and by varying the engagement of the threaded end 64 with the threaded bore 56 an adjustment of the length of the adjustable stabilizer rod 44 is obtained. The lock nut 78 is forced against the front end 52 to lock the front end bearing support 60 to the central rod 50.

The stabilizer rod 44 further includes a rear end bearing support 80 including a rear end enlarged end 82 and a cylindrical end 84. The rear end enlarged end 82 includes a second bearing bore 86 formed therein with a second roller bearing 88 snugly pressed into the second bearing bore 86. A second threaded aperture 90 is formed in the rear end bearing support in communication with the second bearing bore 86, and a second grease fitting 92 threadingly engaging the second threaded aperture 90 allows the introduction of grease into the second bearing bore 86. The second roller bearing 88 includes a second groove 94 formed along the outer periphery thereof and a second aperture 96 formed at a bottom of the second groove 94 communicates between the second groove 94 and the second bearing rollers to allow the introduction of grease to the rollers. A shoulder 98 of the rear end bearing support abuts the back end 54 of the central rod 50 and is welded thereto to secure the rear end bearing support 80 to the central rod 50.

A first hardened pin 100 is provided to snugly engage an upper end aperture 102 formed in the upper end 34 of each arm 28 and the pin slidingly engages the rollers of the first roller bearing 68 to define the front end pivot 46. A first pair of transverse apertures 103 formed near the ends of the pin slidingly receive a pair of first cotter pin 105 to secure the pin 100 in position.

A second hardened pin 110 snugly engaging a pair of aligned apertures 112 formed in the vehicle and slidingly engaging the second roller bearing 88 defines the back end pivot 48. A second pair of transverse apertures 114 formed near the ends of the hardened pin 110 slidingly receive a second pair of cotter pins 116 to secure the second hardened pin 110 in place.

It can thus be seen that the present invention has provided a new and improved vehicle mounted waste receptacle dumping mechanism which produces the effect of minimizing the back lash and play of the mechanism, enables better targeting of the receptacle engaging forks with the receptacle, reduces shock and noise associated with excessive back lash, substantially reduces the amount of wear associated with the use of mechanism, improves the operating life of the device, and reduces down time necessitated by repairs.

It should be understood by those skilled in the art of waste receptacle dumping mechanisms that other forms of the Applicant's invention may be had, all coming within the spirit of the invention and the scope of the appended claims.

Having thus described my invention what I claim is:

1. An improved waste receptacle dumping mechanism including a vehicle mounted cylinder actuated mechanism for engaging and translating a waste receptacle from a first position in front of said vehicle to a second position over a waste receiving opening at a rear portion of said vehicle; a fork associated with said mechanism for releasably engaging the receptacle, cylinder means for pivoting the fork and dumping the contents of the receptacle into the waste receiving opening, the fork supported by a pair of spaced vertical arms each having a lower end and an upper end, each of the lower ends pivotally engaging the fork, a pivot support spaced downward from each of the upper ends of the vertical arms pivotally engaging a forward end of a pair of spaced swinging arms, each swinging arm including a rear end pivotally supported by the vehicle; a pair of adjustable stabilizer rods including a front end pivot attached to the upper ends of the vertical arms and a back end pivot pivotally attached to the vehicle, the stabilizer rods and their pivots configured to stabilize the waste receptacle in a horizontal position as the swinging arms translate the receptacle from the first position to the second position, the adjustable stabilizer rods comprising:

a central rod including a rod front end and a rod back end;

a threaded bore formed longitudinally in the rod front end;

a central bore formed longitudinally in the rod back end;

a front end bearing support including an enlarged end and a threaded end, the enlarged end including a first bearing bore formed therein, a first roller bearing snugly pressed into the bearing first bore;

lock means threadingly engaging the threaded end of the front end bearing support, the threaded end threadingly engaging the threaded bore in the rod front end;

a rear end bearing support including an enlarged end and a cylindrical end, the large end including a second bearing bore formed therein, a second roller bearing snugly pressed into the second bearing bore, the cylindrical end slidingly engaging the central bore in the rod back end, a shoulder formed at an inner end of the cylindrical end, the shoulder secured to the central rod;

a first pin snugly engaging an upper end aperture formed in the vertical arm upper end and slidingly engaging the first roller bearing rollers to define the front end pivot; and a second pin snugly engaging a pair of aligned apertures formed in the vehicle and slidingly engaging the second roller bearing rollers to define the back end pivot.

* * * * *